US005553749A

United States Patent [19]

Oyler et al.

[11] Patent Number: 5,553,749

[45] Date of Patent: Sep. 10, 1996

[54] SELF-CONTAINED BEVERAGE DISPENSING SYSTEM

[75] Inventors: Edward N. Oyler, Newnan; Harold F. Stover, Grantville, both of Ga.

[73] Assignee: S.O.B. Partnership, Newnan, Ga.

[21] Appl. No.: 386,802

[22] Filed: Feb. 6, 1995

Related U.S. Application Data

[63] Continuation of Ser. No. 113,805, Aug. 31, 1993, Pat. No. 5,411,179.

[51] Int. Cl.[6] ..... B67D 5/56

[52] U.S. Cl. ..... 222/129.1; 222/129.2; 222/386.5; 222/389; 222/340; 222/608

[58] Field of Search ..... 222/95, 129.1, 222/129.2, 389, 386.5, 340, 399, 608

[56] References Cited

U.S. PATENT DOCUMENTS

| | | | |
|---|---|---|---|
| 720,902 | 2/1903 | Du Brau | 222/95 |
| 3,158,296 | 11/1964 | Cornelius | 222/386.5 |
| 3,232,489 | 2/1966 | Buffington | 222/129.1 X |
| 3,233,779 | 2/1966 | Cornelius | 222/386.5 X |
| 3,240,395 | 3/1966 | Carver | 222/129.1 |
| 3,348,737 | 10/1967 | Yingst et al. | 222/129.1 X |
| 3,460,713 | 8/1969 | Cornelius | 222/129.1 X |
| 3,590,888 | 7/1971 | Coleman | 141/48 |
| 3,940,019 | 2/1976 | Kross et al. | 222/129.2 |
| 3,949,902 | 4/1976 | Thompson | 222/129.1 |
| 4,034,896 | 7/1977 | Wilson | 222/95 |
| 4,077,543 | 3/1978 | Kulikowski et al. | 222/95 |
| 4,077,544 | 3/1978 | Malacheski et al. | 222/386.5 X |
| 4,120,425 | 10/1978 | Bethurum | 222/386.5 X |
| 4,304,736 | 12/1981 | McMillin et al. | 261/35 |
| 4,582,226 | 4/1986 | Doak | 222/129.1 X |
| 4,886,190 | 12/1989 | Kirschner et al. | 222/57 |
| 5,056,686 | 10/1991 | Jarrett | 222/129.2 |

FOREIGN PATENT DOCUMENTS

| | | | |
|---|---|---|---|
| WO9112196 | 8/1991 | WIPO | 222/386.5 |

*Primary Examiner*—Andres Kashnikow
*Assistant Examiner*—Kenneth Bomberg
*Attorney, Agent, or Firm*—Sughrue, Mion, Zinn, Macpeak & Seas

[57] ABSTRACT

A self-contained beverage dispensing system configured for portable or fixed installations. The beverage system is designed to dispense carbonated and noncarbonated mixed beverages, as well as any carbonated and noncarbonated unmixed beverages in liquid form. In particular, the self-contained beverage dispensing system includes a cabinet and a refillable source of $CO_2$ gas under pressure disposed in the cabinet. A water storage tank is provided for providing flat water and includes a water insolation member, such as a diaphragm, for dividing the water storage tank into a water storage portion and a separate portion, the separate portion designed for either accepting pressurized $CO_2$ gas or for housing a compression spring for biasing the diaphragm so as to force the flat water out of the water storage portion. An isolation storage tank is provided for storing a non-carbonated beverage. The internal construction of the isolation storage tank is similar to that of the water storage tank. A carbonator is provided for carbonating at least a portion of flat water which is supplied from the water storage tank. A dispensing valve is provided for dispensing a selected one of the flat water, the carbonated water and the non-carbonated beverage. The dispensing valve is communicated with each of the water storage tank, the carbonator and the isolation storage tank by suitable pipelines.

12 Claims, 11 Drawing Sheets

FIG.6
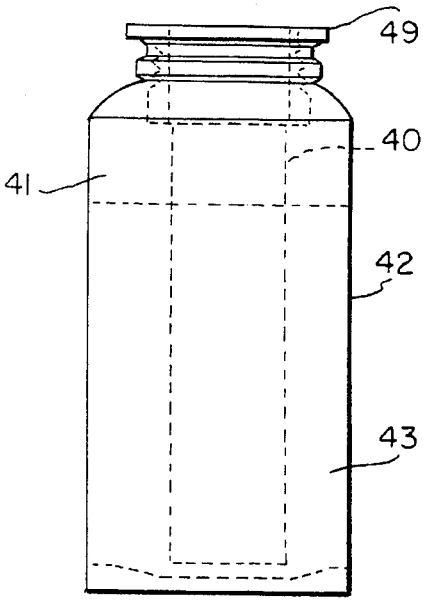
FIG.7
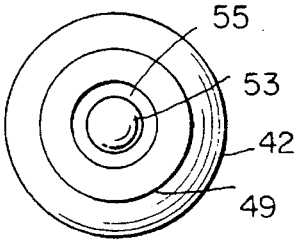
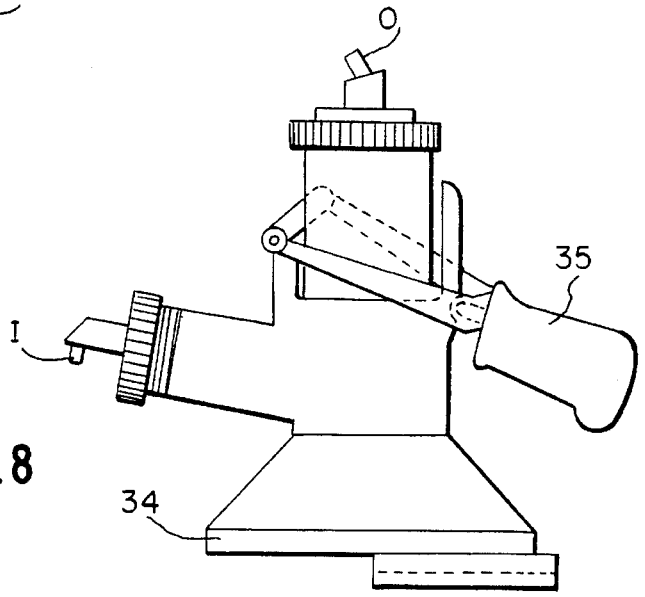
FIG.8
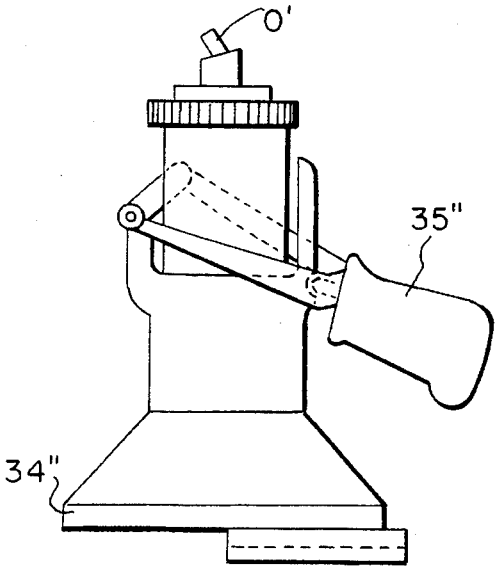
FIG.12

SELF-CONTAINED BEVERAGE DISPENSING SYSTEM

This is a continuation of application Ser. No. 08/113,805 filed Aug. 31, 1993 now U.S. Pat. No. 5,411,179.

BACKGROUND OF THE INVENTION

1. Field of the Invention

The present invention relates to a self-contained beverage dispensing system configured for portable or fixed installations. The beverage system is designed to dispense carbonated and noncarbonated mixed beverages, as well as any carbonated and noncarbonated unmixed beverages in liquid form. The self-contained beverage dispensing system is especially adapted for use on commercial aircraft, railcars, buses and ships or at sporting events.

2. Description of the Related Art

Conventionally, beverage dispensing systems for use on, for example, commercial aircraft have required pumps, motors, or sources of power such as electricity or gasoline. Accordingly, such systems are bulky and expensive to maintain and operate.

Furthermore, the conventional beverage dispensing systems which utilize pressurized air or $CO_2$ in order to force delivery of a desired beverage are unable to isolate, for an extended period of time, the beverage being dispensed from the gas propellant. In short, the gas propellant is in direct contact with the beverage being dispensed. Such a condition is unacceptable when dispensing liquids such as flat water, fruit juices, alcohol spirits, etc., where gas permeation clearly is undesirable.

U.S. Pat. No. 3,949,902 (Thompson) discloses a portable dispensing bar that may be used on an airplane or railroad dining cars. However, this system requires a battery pack in order to provide power for driving the electric motor driven dispensing pumps.

U.S. Pat. No. 4,304,736 (McMillin et al.) discloses a method of and apparatus for making and dispensing a carbonated beverage utilizing propellant carbon dioxide gas for carbonating. However, the apparatus requires the use of a pneumatically driven water pump. Further, the McMillin et al. device has no provision for supplying noncarbonated beverages.

U.S. Pat. No. 3,240,395 (Carver) discloses a self-contained, portable, carbonating dispensing system requiring no external connecting lines for electricity or gas. However, the Carver system allows the $CO_2$ to contaminate the water supply, since the $CO_2$ is in direct contact with the water. Further, there is no provision in the Carver system for dispensing noncarbonated beverages such as fruit juice, tea and alcohol spirits.

U.S. Pat. No. 4,886,190 (Kirschner et al.) disclose a postmix juice dispensing system for reconstituting and dispensing pliable 5+1 orange juice concentrate at freezer temperatures of from about −10° F. to 0° F. The device includes a flexible bag 30 which is disposed in a pressurized canister 32 which can be pressurized by pressure sources such as $CO_2$ or compressed air. There is no provision for dispensing both carbonated and noncarbonated mixed beverages, as well as a carbonated and noncarbonated unmixed beverages in liquid form.

U.S. Pat. No. 3,590,888 (Coleman) discloses a composite container including a flexible bag and a rigid shell.

SUMMARY OF THE INVENTION

It is an object of the present invention to provide a self-contained beverage dispensing system that dispenses carbonated and noncarbonated mixed beverages, as well as any carbonated and noncarbonated unmixed beverages in liquid form.

It is a further object to provide a self-contained beverage dispensing system which requires no repetitional pumps, motors or sources of power such as electricity or gasoline. Instead, the system is powered solely by pressurized gas such as air or $CO_2$ stored in a refillable container and which propels mixed or unmixed liquids from respective refillable storage vessels to a dispensing apparatus.

It is yet another object of the present invention to provide a self-contained beverage dispensing system which is able to isolate, for an extended period of time, the particular beverage being dispensed from the propellant gas. For example, flat water, fruit juices, alcohol spirits, etc. may be stored for extended periods of time and later served without contamination from the propellant gas, such as $CO_2$, used to dispense the beverages.

It is a still further object to provide a self-contained beverage dispensing system in which at least some beverages and/or water may be dispensed by a spring-biased diaphragm instead of a propellant gas.

It is a still further object to provide a self-contained beverage dispensing system which is especially adapted for use on commercial aircraft, railcars, buses and ships or at sporting events.

In particular, the self-contained beverage dispensing system includes a housing means and a refillable source of $CO_2$ gas under pressure and disposed in the housing means. A water storage means, disposed in the housing means, is provided for storing flat water and includes a water isolation means, such as a diaphragm, for dividing the water storage means into a water storage portion and a separate portion, the separate portion including means for biasing the water isolation means and operative to force the flat water out of the water storage portion. An isolation storage means, disposed in the housing means, is provided for storing a non-carbonated beverage and includes a beverage isolation means, such as a diaphragm, for separating the isolation storage means into a beverage storage portion and a separate portion, the separate portion of the isolation storage means including means for biasing the beverage isolation means and operative to force the non-carbonated beverage out of the beverage storage portion. A carbonator is provided for carbonating at least a portion of the flat water which is supplied from the water storage means. The carbonator is in communication with the $CO_2$ gas source. A dispensing valve means is provided for dispensing a selected one of the flat water, the carbonated water and the non-carbonated beverage; and means for communicating the dispensing valve means with each of the water storage means, the carbonator and the isolation storage means are likewise provided.

The biasing means for biasing the water isolation means in the water storage means, and likewise the biasing means for biasing the beverage isolation means in the isolation storage means, may comprise either pressurized $CO_2$ gas supplied from the $CO_2$ gas source, or may take the form of a compression spring interposed between the diaphragm and the respective storage means.

The beverage dispensing system may further include a refillable beverage storage means disposed in the housing means and a $CO_2$ gas pipeline for communicating the $CO_2$ gas source with an upper portion of the refillable beverage storage means. The refillable beverage storage means includes a take-up tube which extends downwardly into the refillable beverage storage means and which communicates with the dispensing valve means through the communicating means. Accordingly, $CO_2$ gas under pressure directly contacts a further beverage, which is intended to be carbonated, stored in the refillable beverage storage means and is operative to force the further beverage out through the take-up tube and to the dispensing valve means, and the further beverage is dispensed as a carbonated beverage from a dispensing nozzle.

The housing means may take the form of a portable cabinet mounted on wheels and which is adapted for use on, for example, commercial aircraft.

The present invention also relates to a refillable liquid storage tank for use in a liquid dispensing system. The storage tank includes a first circular dome-shaped tank portion having an open end with a flange extending therefrom, and a second circular dome-shaped tank portion having an open end with a flange extending therefrom, and which faces the open end of the first tank portion. A diaphragm, having a periphery thereof sandwiched between the flanges of the first and second tank portions, is provided. Further, a biasing means, in the form of a compression spring or pressurized $CO_2$ gas, is interposed between the diaphragm and one of the first and second tank portions for biasing the diaphragm away therefrom, wherein a side of the diaphragm opposite to the biasing means together with the other of the first and second tank portions form a liquid storage portion for storing a liquid to be dispensed.

BRIEF DESCRIPTION OF THE DRAWINGS

Other features and advantages of the present invention will be apparent from the following description taken in connection with the accompanying drawings, wherein:

FIG. 6 is a side elevational view of an individual refillable product storage tank according to the first embodiment;

FIG. 7 is a top view of the refillable product storage tank of FIG. 6;

FIG. 8 is a side elevational view of the coupler and coupler handle according to the first embodiment;

FIG. 12 is a side elevational view of the coupler and coupler handle according to the second embodiment;

DETAILED DESCRIPTION OF THE PREFERRED EMBODIMENTS

Figure 1:
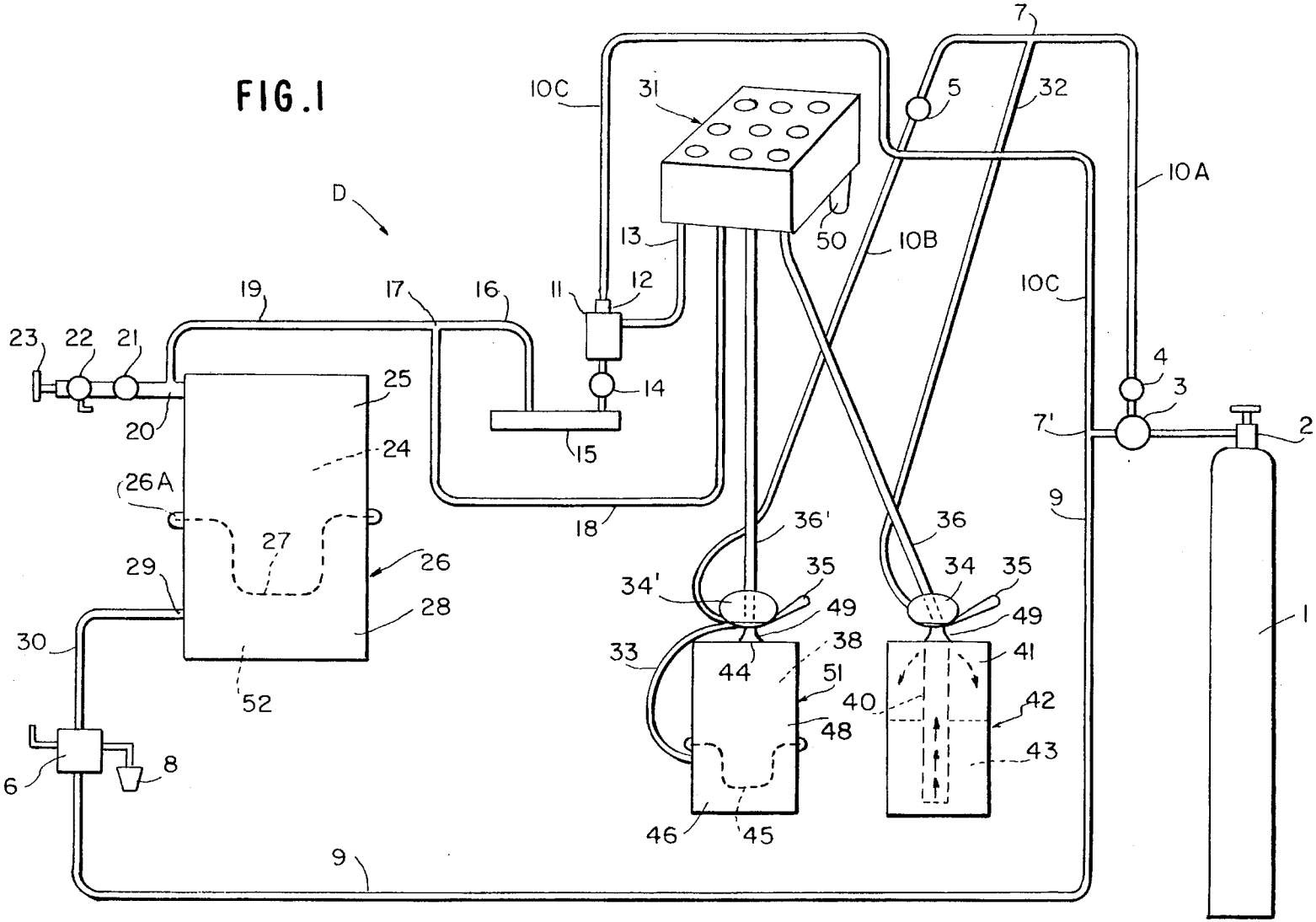
FIG. 1 is a schematic view of the self-contained beverage dispensing system according to a first embodiment of the present invention.

The invention will now be described with reference to the drawings. As shown in FIG. 1, the self-contained beverage dispensing system is generally denoted by the letter D. FIG. 1 is a schematic view of the self-contained beverage dispensing system according to a first embodiment of the present invention in order to facilitate an understanding of the fluid hook-ups between the various elements of the system.

More specifically, a refillable gas storage container 1 is provided for storing pressurized gas such as air or carbon dioxide ($CO_2$). As will be described in more detail later on, the pressurized $CO_2$ gas stored in the refillable container 1 not only serves as the propellant gas which propels mixed or unmixed beverages in liquid form from their respective storage vessels, but also is used to carbonate a particular beverage when desired.

Propellant gas exits the refillable gas storage container 1 through a gas shut-off valve 2. The propellant gas then travels through a primary regulator 3. From the primary regulator 3, the gas exits at two separate locations, with a first location being connected to a pipeline tee 7'. The pipeline tee 7' divides the gas flow in two directions, with one direction directing the gas into a pipeline 10C and the other direction directing the gas into a pipeline 9.

The pipeline 9 directs tire gas to a three-way vent valve 6 which is manually operative to control the pressurization or depressurization of the lower portion 28 of a water storage means in the form of a water storage tank 26 which is designed for storing and distributing flat water. When the three-way vent valve 6 is positioned in a venting mode, propellant gas from the pipeline 9 is shut off, and residual gas under pressure in the lower portion 28 of the water storage tank 26 is exhausted from the lower portion 28 of the water storage tank 26 through a tank gas inlet/outlet 29 and gas line 30, through the three-way vent valve 6, and then to atmosphere through a diffuser 8.

Propellant gas which has entered the primary regulator 3 can likewise exit at a second location and pass through a secondary regulator 4, for pressure reduction, and then through a pipeline 10A. The propellant gas passing through the pipeline 10A then enters into a pipeline tee 7 where the propellant gas is diverted in part to a gas inlet pipeline 32 and then into a coupler 34 of a refillable product storage means in the form of a tank or container 42 so as to pressurize the upper section 41 of the refillable storage tank 42. The product 43, for example, a soft drink in syrup form which has been stored in the refillable product storage tank 42, is forced out through a take-up tube 40, through the coupler 34 and to a liquid outlet tube 36, when a dispensing means in the form of a dispensing valve 31 is triggered, thereby causing the product to be dispensed from an outlet nozzle 50.

The beverage or product stored in the refillable product storage tank 42 is one that is intended to be carbonated so that the $CO_2$ propellant gas may directly contact the beverage within the tank 42 when forcing the beverage out the take-up tube 40. Although some $CO_2$ gas will be dissolved into the beverage, which is stored as a syrup within the tank 42, during dispensing of the beverage, the syrup exits through openings in the nozzle 50 simultaneously with carbonated water which exits from additional openings that surround the syrup openings so that the syrup and carbonated water are post-mixed in the container into which they are dispensed.

The dispensing valve 31 per se is known in the art so that the particulars thereof will not be discussed herein. A suitable dispensing valve that may be employed in the present invention is sold under the tradename WUNDER-BAR having a Part No. 14840. The WUNDER-BAR may have a single dispensing button or up to as many as sixteen dispensing buttons thereon as is well known to those skilled in the art.

The remaining propellant gas passing through the secondary pipeline 10A passes through the pipeline tee 7, through a still further regulator 5, and then subsequently through a pipeline 10B. The pipeline 10B directs the propellant gas to a gas valve inlet 33, where the propellant gas is introduced into a lower gas portion 46 of an isolation storage means in the form of an isolation storage unit 51. The pressurized propellant gas is isolated in the lower gas propellant portion 46 from a product 38, to be dispensed, by a product or beverage isolation means in the form of a pliable diaphragm 45. The pliable diaphragm 45 separates and seals the lower portion 46 of the unit 51 from the upper, product portion 48.

The particular product 38 which is stored in the upper, product portion 48 includes beverages such as fruit juices, alcohol spirits, tea, etc., where carbonation of the beverage is unacceptable.

When an operator presses a button on the dispensing valve 31 so as to select the product 38 contained within the upper, product portion 48 of the isolation storage unit 51, the product 38 is forced out of the upper product portion 48 by the overriding gas pressure in the lower portion 46 which acts on the diaphragm 45. The product 38 passes through an outlet 44 of the upper, product portion 48, to a coupler 34', and then through the product outlet tube 36' which is connected at its opposite end to the dispensing valve 31. The product or beverage is then dispensed through the outlet nozzle 50.

Both the refillable product storage tank 42 and the isolation storage unit 51 utilize a coupler retainer 49 to which is attached the coupler 34 and coupler 34', respectively The couplers 34, 34' are removable by means of a handle 35 which is unlatched and latched during replacement of the refillable product storage container 42 and the isolation storage unit 51. The refillable product storage container 42 and the isolation storage unit 51, as well as the coupler 34, 34' will be discussed in more detail later on in connection with FIGS. 5–9.

The present invention also provides for the dispensing of either carbonated water or noncarbonated (i.e., flat) water. In particular, fresh water is added through a quick-disconnect water inlet 23 during replenishment of the water storage tank 26. While the water is being replenished through the water inlet 23, the water passes through a manual ball-type shut-off valve 22, which is in an open, refill position, a one-way check valve 21, and then to a pipeline tee 20. Once the water storage tank 26 has been filled with water, the water supply member (not shown) is disconnected from the quick-disconnect water inlet 23 and the water shut-off valve 22 is manually returned to its closed position.

Flat water 24 is stored in an upper water storage portion 25 of the water storage tank 26 and is isolated from the lower gas portion 28 of the water storage tank by water isolation means in the form of a pliable diaphragm 27. The flat water 24 is held in storage in the water storage tank 26 and simultaneously held in a flat water line 19 and a cold water plate 15 which is connected to the flat water line 19 through a pipeline tee 17 and a water inlet 16.

The cold plate or chiller 15 per se is well known in the art and simply cools the flat water 24 to a desired temperature level. The cold plate 15 is connected to a water inlet side of a carbonator 11 through a one-way check valve 14. Pressurized $CO_2$ passes through the primary regulator 3 to the pipeline tee 7' and then passes through the pipeline 10C which is connected to the carbonator 11 through a gas check valve 12, thereby to introduce $CO_2$ into the carbonator 11 so as to complete the carbonation process necessary to carbonate the flat water 24 and thus supply carbonated water through a carbonated water discharge line 13 to the dispensing valve 31 and finally out through the discharge nozzle 50. Depending on the button pushed on the dispensing valve 31, either the carbonated water alone is dispensed, or the carbonated water is dispensed together with a beverage syrup from the nozzle 50 in a postmix fashion as described above. The carbonator 11 per se is well known in the art and therefore a detailed description thereof is unnecessary. A suitable "off-the-shelf" carbonator which may be employed in the present invention is manufactured under the tradename GARRARD.

The flat water 24 stored in the upper water storage portion 25 of the tank 26 and passing through the flat water line 19 is diverted in part through the pipeline tee 17 to a further flat water line 18 which leads directly to the dispensing valve 31 and thus out the discharge nozzle 50, thereby bypassing the cold plate 15 and carbonator 11.

Accordingly, when carbonated water is desired, the operator simply presses the appropriate button on the dispensing valve 31 thereby to cause the pressurized gas 52 within the lower portion 28 of the water storage tank 26 to push against the pliable diaphragm 27 and thereby force the water 24 out of the upper water storage portion 25 of the water storage tank 26 and through the flat water line 19, pipeline tee 17, water inlet 16, cold plate 15, past the check valve 14 into the carbonator 11, where the water is carbonated, and finally through the carbonated water discharge line 13 to the dispensing valve 31 and out the discharge nozzle 50. On the other hand, when flat water is desired, the operator presses the desired button on the dispensing valve 31 such that water is forced out of the upper water storage portion 25 of the water tank 26 into the flat water line 19, the tee 17 and through the additional flat water line 18 to the dispensing valve 31 to be dispensed directly from the nozzle 50.

The present invention will now be discussed in connection with a specific application of the self-contained beverage dispensing system as a portable, wheeled beverage dispenser. Structural elements which correspond to those illustrated in the schematic view of FIG. 1 are designated by the same reference numerals. Further, while the self-contained beverage dispensing system is shown as a portable, wheeled beverage dispenser, it is to be understood that the system could likewise be fixed or permanently installed at a convenient location. For example, the self-contained beverage dispensing system could be fixedly installed in the galley portion of a commercial aircraft which is proximate to the first class section thereof, since the first class section is normally small enough so as not to require a portable beverage dispensing system.

Figure 2:
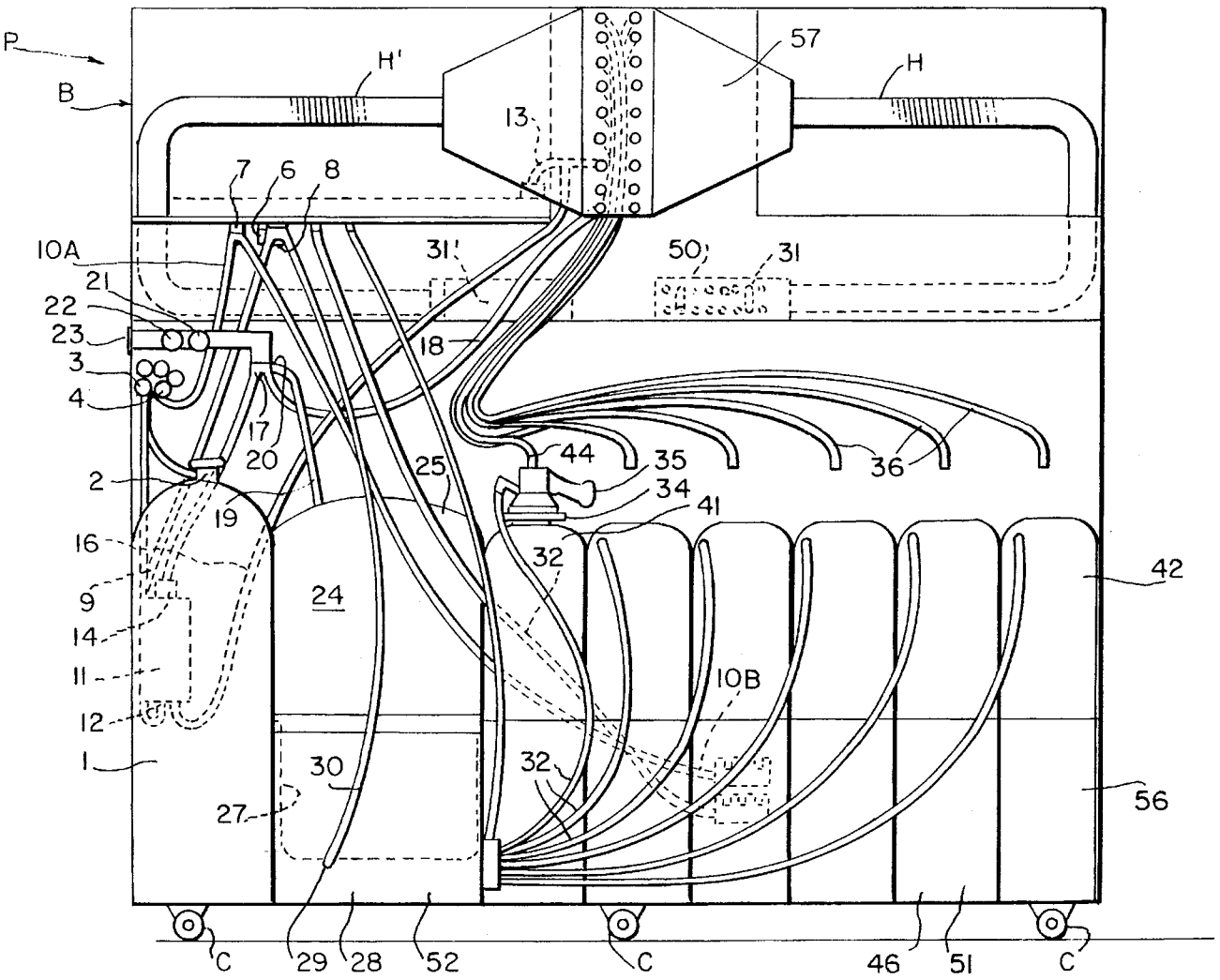
FIG. 2 is a side elevational view of the self-contained beverage dispensing system according to the first embodiment of the present invention, wherein the various elements are disposed in positions which could be suitably located within a portable, wheeled beverage dispenser, the side wall of which has been removed to expose the elements.
Figure 3:
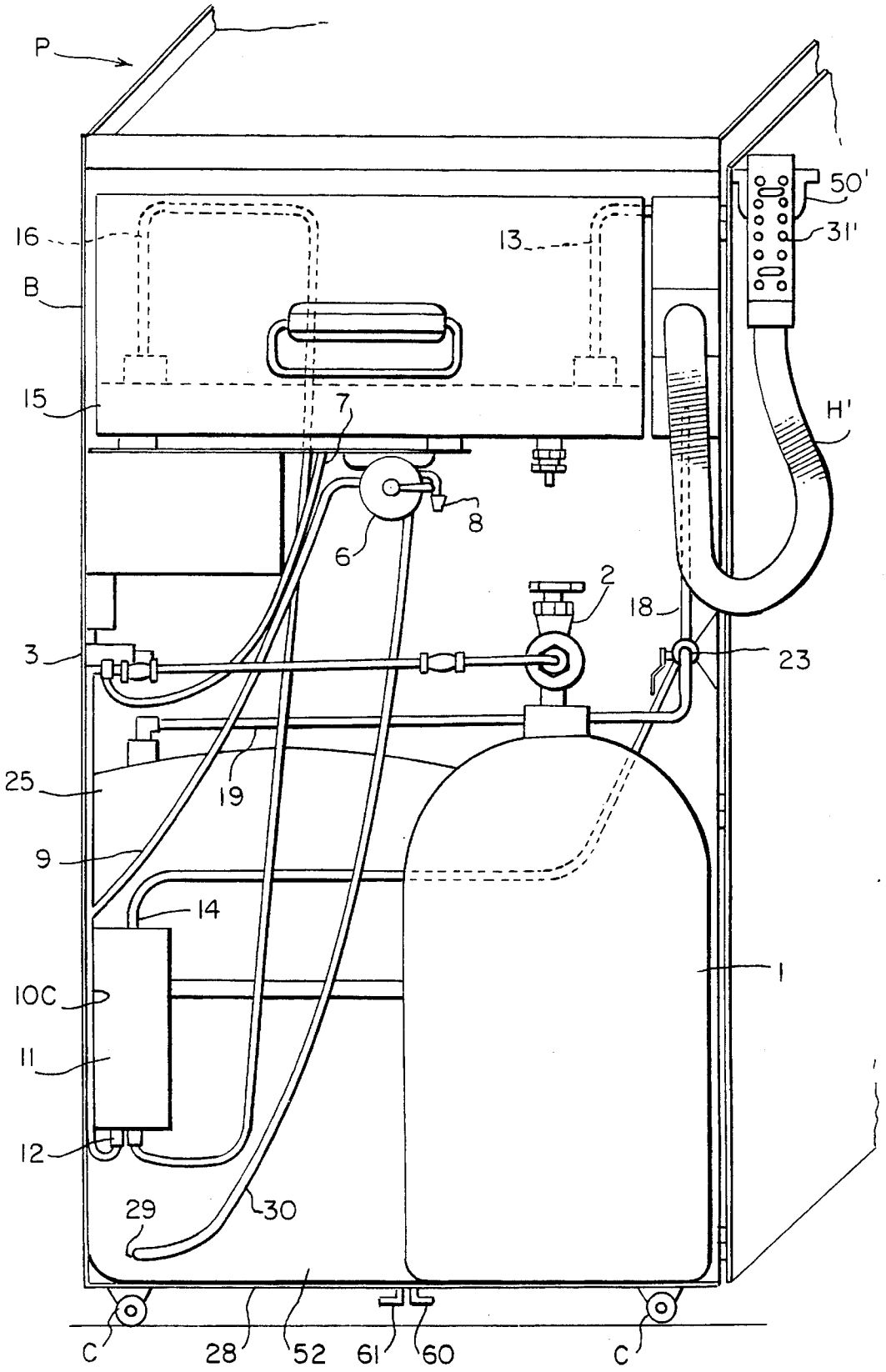
FIG. 3 is a fragmentary perspective view of the left end portion of the portable beverage dispenser of FIG. 2, wherein a portion of the end wall has been removed to expose the internal elements.
Figure 4:
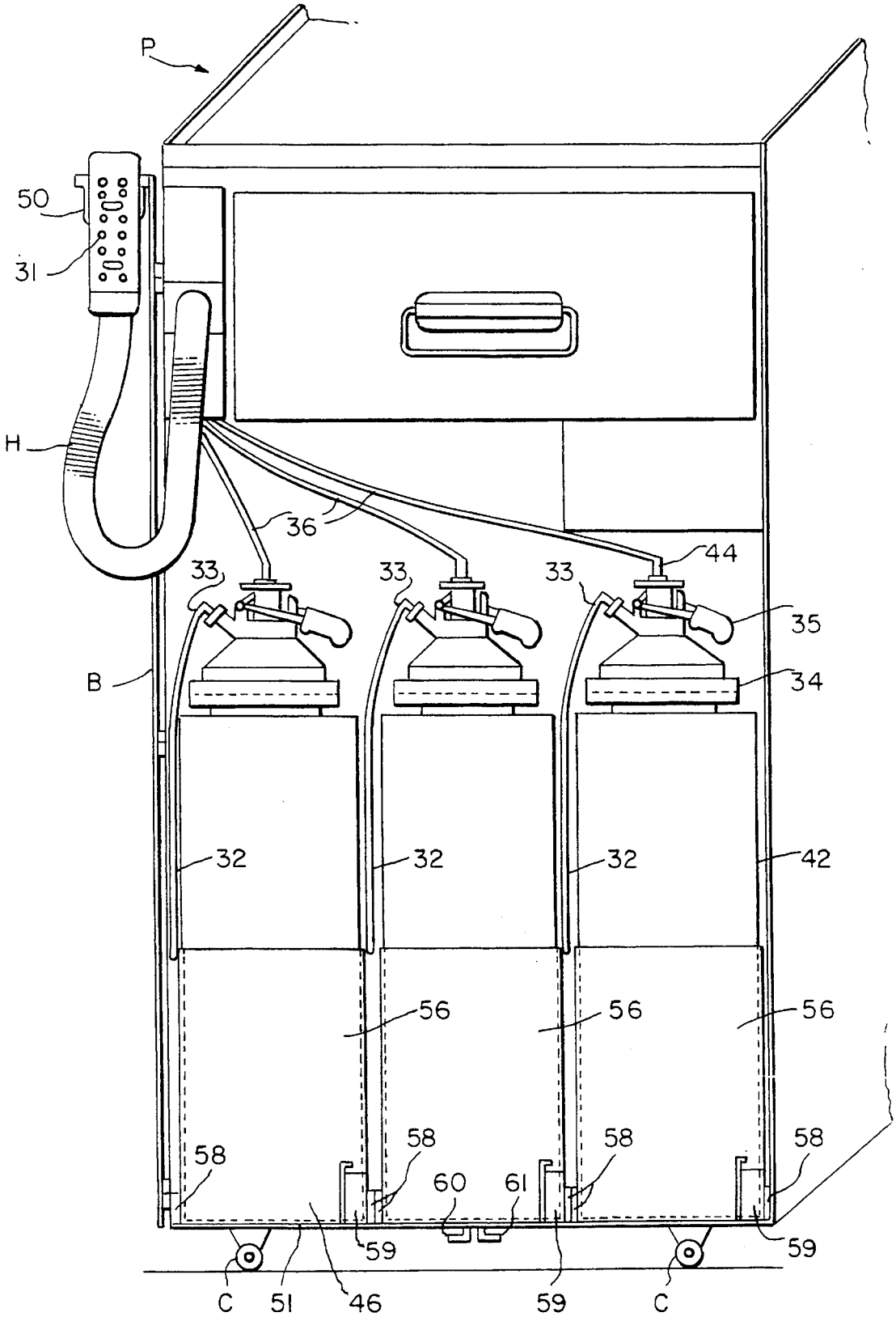
FIG. 4 is a fragmentary perspective view of the right end portion of the portable beverage dispenser of FIG. 2, wherein a portion of the end wall has been removed to expose the internal elements.

FIG. 2 shows a side elevational view of the self-contained beverage dispensing system according to the present invention, wherein the various elements are disposed in positions which could be suitably located within a portable, wheeled beverage dispenser P. The side wall or panel has been removed so as to expose the various elements contained within the portable, wheeled beverage dispenser P. FIG. 3 is a fragmentary perspective view of the left end portion of the portable beverage dispenser of FIG. 2, wherein a portion of an end wall has been removed to expose the internal elements. FIG. 4, on the other hand, is a fragmentary perspective view of the right end portion of the portable beverage dispenser of FIG. 2, wherein a portion of the end wall has been removed to expose the internal elements.

As shown in FIG. 2, the wheeled beverage dispenser P is disposed in a housing means in the form of a cabinet B which includes a plurality of casters C on the bottom thereof so as to be easily maneuvered, for example, down the aisle of a commercial aircraft. As mentioned above, the beverage dispenser could be permanently mounted in the galley portion of the commercial aircraft by simply removing the casters and fitting the rectangular, box-like dispenser unit P within a complementary-shaped space provided in the galley portion of the aircraft. The water storage tank hook-up is optional in this system since the water source is part of the galley.

Although the dispensing system D is depicted schematically in FIG. 1 with only a single refillable product storage tank 42 and a single isolation storage unit 51, in actual practice, the dispensing unit P normally will include a plurality of the refillable product storage tanks 42 and the isolation storage units 51 as shown in FIGS. 2 and 4. Because the dispensing unit P includes a plurality of the refillable product storage containers 42 and the isolation storage units 51, a distribution manifold 57 is necessary to connect all of the beverage outlet tubes 36 up to the dispensing valve 31. The dispensing valve or wand 31 is shown in its stored position in FIG. 2. In addition to the dispensing valve 31 along with its corresponding connecting hose H, which is connected to the distribution manifold 57, a second dispensing valve 31' and connecting hose H' are connected to the distribution manifold 57 at the left-hand side. FIG. 3 shows the dispensing valve 31' and corresponding hose H' in their operative position wherein they are suspended on an outside portion of the beverage dispensing unit P. Similarly, FIG. 4 shows the dispensing valve 31 also disposed in its operative position wherein it is suspended from the outside of the beverage dispensing unit P. Also note that in FIG. 2, only a single coupler 34 is illustrated for the sake of clarity.

As best seen in FIG. 4, the refillable product storage containers 42 and the isolation storage units 51 are held in storage containers 56 which can be slid in and out of the beverage dispensing unit P and then fixed into position. This allows for simple removal of the containers 42 and units 51 in order to clean and/or refill the same. A Locking pedal 60, for braking the unit P, and a brake release 61 are shown schematically.

Figure 5:
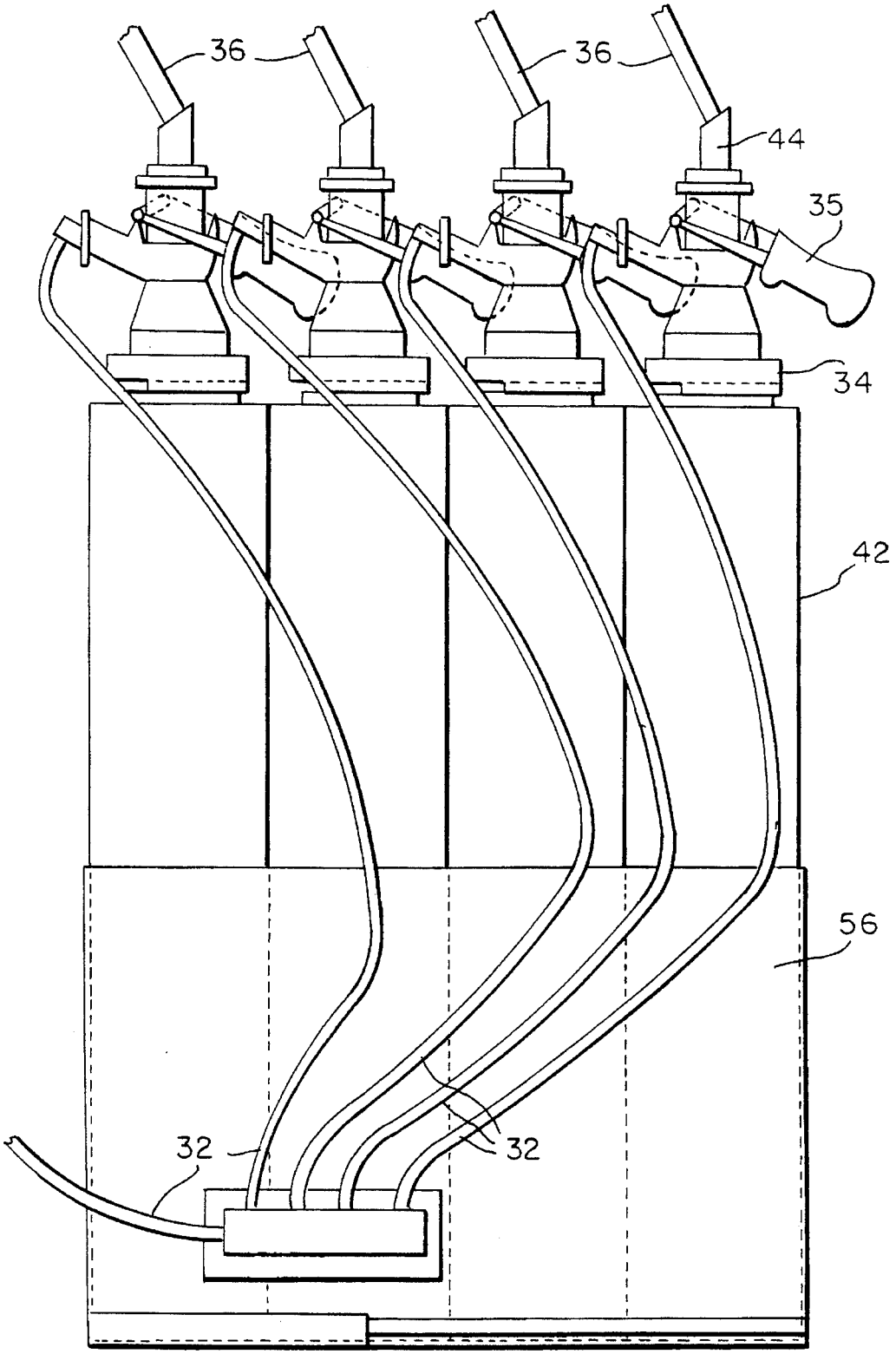
FIG. 5 is a fragmentary side elevational view of a plurality of refillable product storage tanks.

FIG. 5 shows a group of four of the refillable product storage containers 42 held as a unit on a single slidable storage container 56.

FIGS. 6–8 illustrate the details of an individual refillable product storage container 42. More specifically, as shown in the side elevational view of FIG. 6, the refillable product storage container 42 includes a coupler retainer portion 49 at the top thereof. A ball check valve 53 and a seal 55 are built into the coupler retainer portion 49 (see FIG. 7) in order to seal the refillable product storage container 42 from contamination (i.e., from oxygen, bacteria, etc.).

FIG. 8 shows a side elevational view of the coupler 34. The coupler 34 per se is well known in the art. A suitable coupler which may be employed is manufactured under the tradename MICROMATIC. The couplers 34 and 34' are identical in description so that only the coupler 34 is shown in detail. The coupler 34 includes a coupler gas inlet I for receiving the propellant gas, a liquid outlet O for connection to the liquid outlet tube 36, and a coupler handle 35.

In operation, propellant gas enters into the coupler 34 through coupler gas inlet I, which is connected to gas inlet pipeline 32, and then passes into the upper section 41 of the refillable storage tank 42 so as to force the syrup out through the take-up tube 40.

Figure 9:
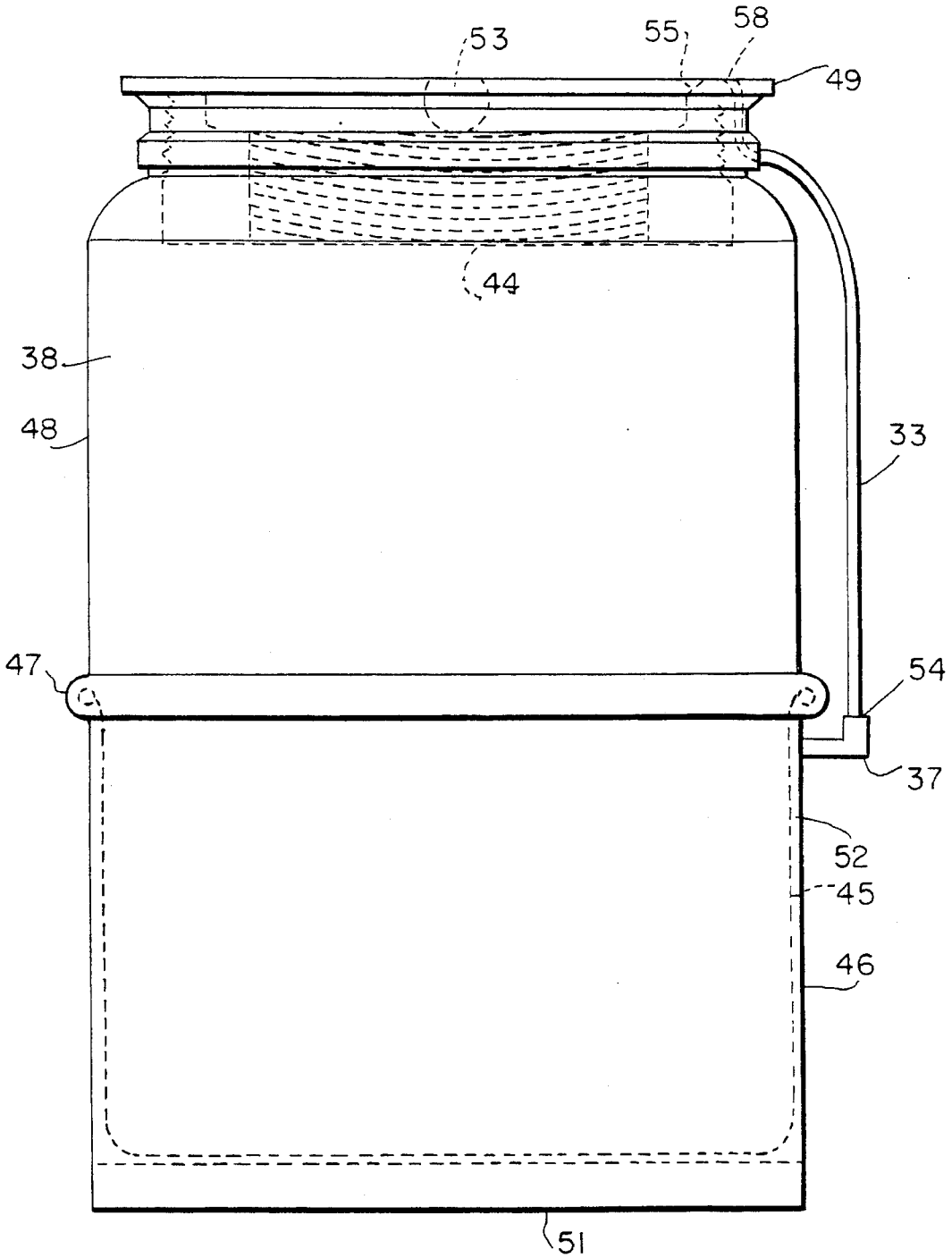
FIG. 9 is a side elevational view of the isolation storage unit according to the first embodiment and including the refillable product storage portion and gas propellant portion.

FIG. 9 is a side elevational view of the isolation storage unit 51 including the upper, refillable product storage portion 48 and the lower, gas propellant portion 46. The coupler retainer portion 49 of the isolation storage unit 51 is similar to that of the refillable product storage tank 42 although an internal gas passage 58 is formed in the coupler retainer 49 and communicates with an external pipe portion 33 in order to bypass the upper, product portion 48 and connect to the gas inlet 37 which communicates with the lower portion 46 to permit propellant gas to act on the pliable diaphragm 45. A tank retainer means 47 similar to the water tank retainer 26A (described below) is provided.

Figure 10:
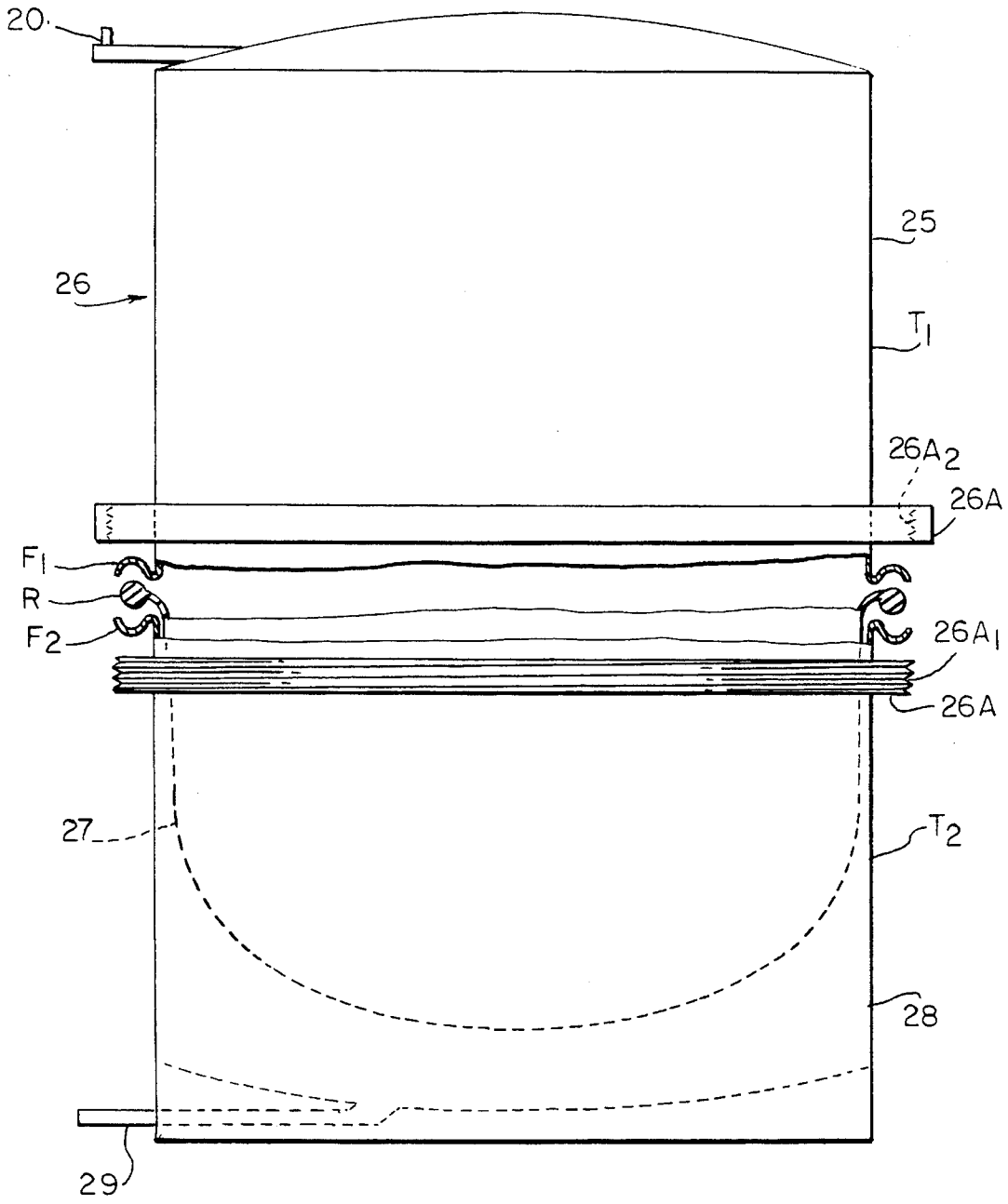
FIG. 10 is a side elevational view of the water storage tank according to the first embodiment.

FIG. 10 is a side elevation view of the water storage tank 26 according to the first embodiment of the present invention. In particular, the water storage tank 26 has a generally circular shape and is constructed so as to have an upper circular dome-shaped half $T_1$, and a lower circular dome-shaped half $T_2$ which are joined together at an intermediate portion by retainer 26A. The retainer 26A includes an externally threaded ring-like member $\mathbf{26A_1}$ which engages the lower tank portion at the intermediate portion thereof, and an upper internally threaded ring-like member $\mathbf{26A_2}$ which engages the upper tank portion at the intermediate portion thereof. The retainer 26A is shown disengaged in FIG. 10 for the sake of clarity. An outer annular sealing rim portion R of the diaphragm 27 is fitted into the flanges F1 and F2 of the upper and lower tank portions. The upper and lower portions of the tank 26 are engaged together in a sealing manner by threadedly engaging the rings of the retainer 26A.

Various other types of mated flanges to be constricted to form a hermetic seal may be employed. Typical examples of constricting flanges are: bolted, riveted, welded, soldered, crimped, clamped, straped, etc.

FIGS. 11–14 illustrate a second embodiment of the present invention. Structural elements similar to those illustrated for the previous embodiment are designated by the same reference numerals.

Figure 11:
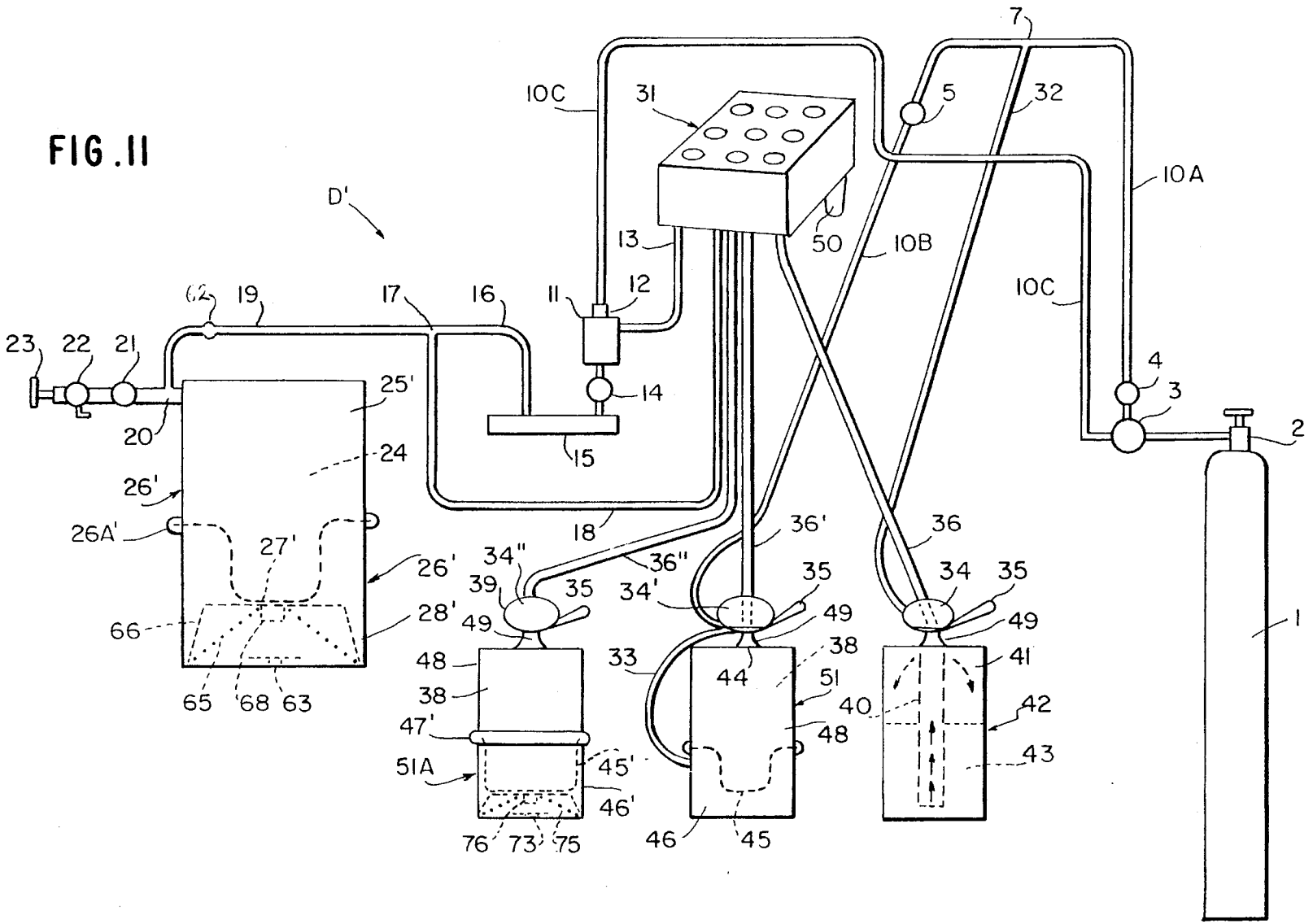
FIG. 11 is a schematic view of the self-contained beverage dispensing system according to a second embodiment of the present invention.
Figure 14:
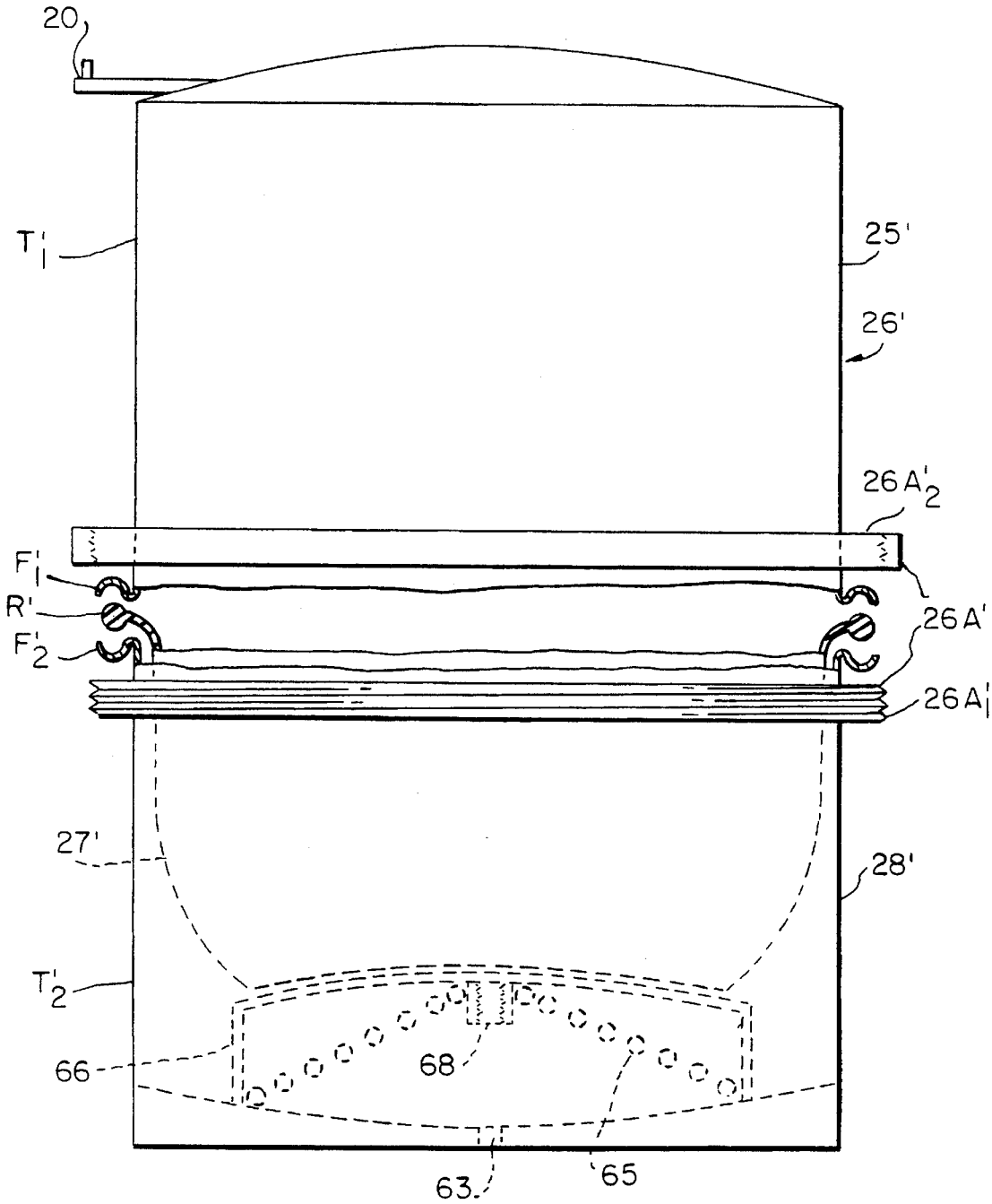
FIG. 14 is a side elevational view of the water storage tank according to the second embodiment.

More specifically, according to the second embodiment, the self-contained dispensing system D' differs from the first embodiment mainly in that the second embodiment utilizes a water storage tank 26' having a compression spring 65 and a piston 66 thereby serving as a biasing means to apply pressure against the diaphragm 27' for pressurizing the water in the upper water storage portion 25', as shown in FIGS. 11 and 14. The compression spring 65 and piston 66 replace the pressurized propellant gas utilized in the first embodiment as the biasing means for actuating the diaphragm 27' and distributing the water from the water storage tank 26' and out of the pipeline tee 20 to a pressure regulator 62 and then on through the line 19 to the remainder of the system to be dispensed as either carbonated water or flat water as described in detail above with respect to the first embodiment.

In order to service the internal components of the water storage tank 26', a vent plug 63 is provided in the bottom of the lower tank portion 28'. The vent plug 63 is a threaded member that is removed to allow insertion of a bolt (not shown) through the vent plug hole and into a threaded hole 68 formed in the piston 66. The inserted bolt simply allows the spring 65 to be held in a compressed mode to permit removal of the retainer 26A'. Once the retainer 26A' is removed, the water storage tank 26' may be separated for servicing of the internal components such as the diaphragm 27'.

In order to refill the water storage tank 26', an external water supply member (not shown) is connected to the quick-disconnect inlet 23 and the manual shut-off valve 22 is turned to its open position so that water enters the upper water storage portion 25' of the water storage tank 26' through the pipeline tee 20. The replenishing water entering the upper water storage portion 25' forces the diaphragm 27' to downwardly compress the spring 65. When the upper water storage portion 25' is filled with water, the shut-off valve 22 is manually turned to the closed position and the water supply member is disconnected from the quick-disconnect water inlet 23. The water storage tank 26' is then ready for service.

The second embodiment also contemplates the use of an additional isolation storage unit 51A which is similar to the water storage tank 26' of the second embodiment in that it utilize a compression spring 75 to apply pressure against the diaphragm 45' instead of relying on propellant gas to do the same.

Figure 13:
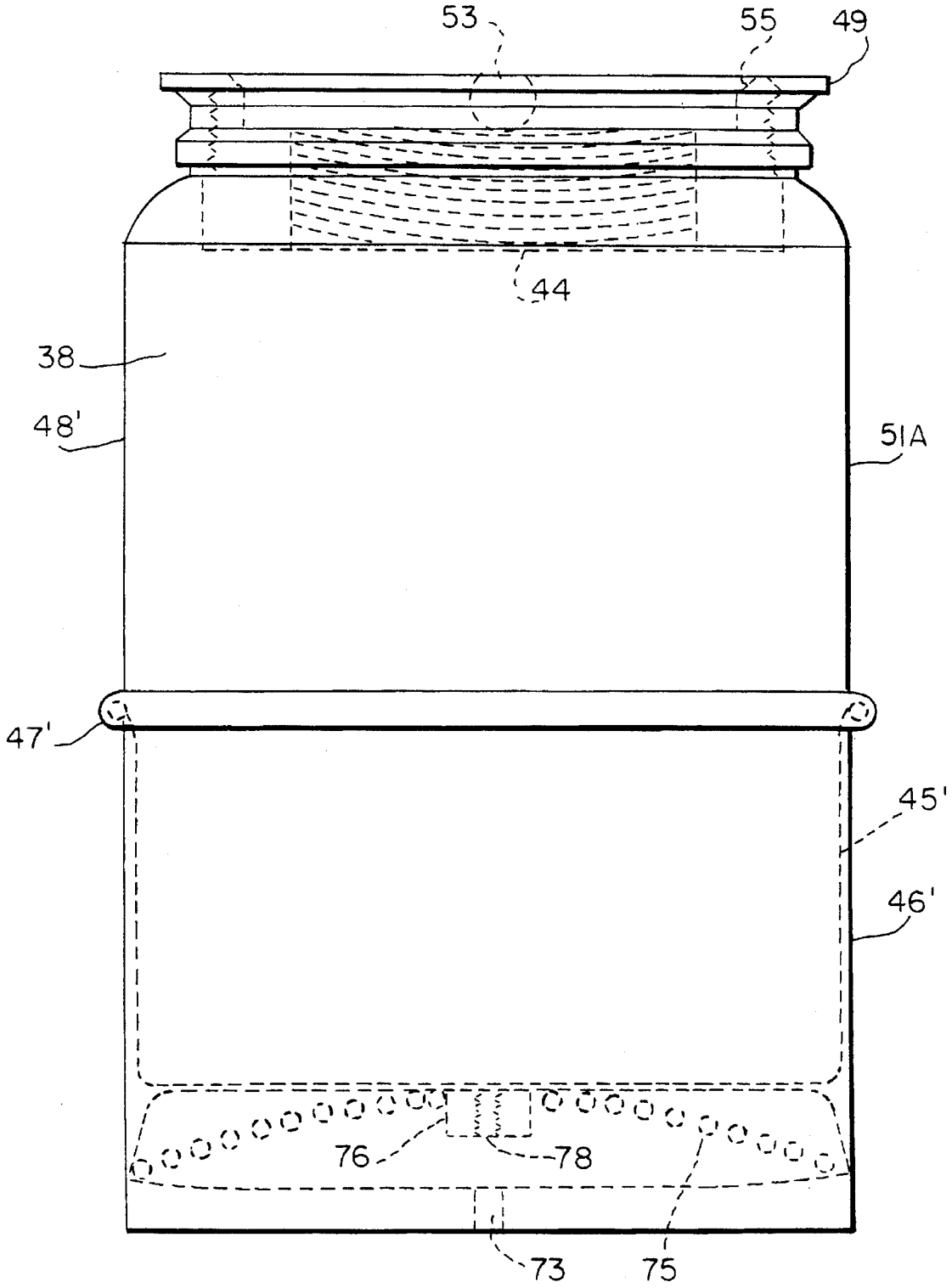
FIG. 13 is a side elevational view of the isolation storage unit according to the second embodiment.

As best shown in FIG. 13, the isolation storage unit 51A includes a coupler retainer portion 49 at the top thereof. A ball check valve 53 and a seal 55 are built into the coupler retainer portion 49 in order to seal the unit 51A from contamination. As shown in FIG. 12, the coupler 34" is a single port coupler that is designed to attach to the coupler retainer portion 49 and is locked in an open position by depressing the handle 35". The coupler 34" only requires the single port O' since the compression spring 75 is utilized to actuate the diaphragm 45' in place of the propellant gas.

The isolation storage unit 51A is serviced in a manner similar to the procedure described above with respect to the water storage tank 26'. More specifically, the vent plug 73 is removed from the lower portion of the unit 51A and a bolt (not shown) is inserted through the vent hole and is threaded into a hole 78 formed in the piston 76 in order to hold the spring in the compressed mode The tank retainer 47', which corresponds in structure to the retainer 26A of the water storage tank 26, is then removed to separate the unit 51A for servicing.

The operation of the self-contained beverage dispensing system according to the second embodiment of the present invention is similar to that of the first embodiment, except that when the user chooses water, whether carbonated or flat, the compression spring 65 acts on the diaphragm 27' to force the water out of the water storage tank 26' and eventually out of the discharge nozzle 50. Likewise, if the user wishes to dispense a beverage held in the isolation storage container 51A, the compression spring 75 biases the diaphragm 45' so as to force the product or beverage out of the unit 51A and into the outlet tube 36".

While only a single isolation storage unit 51A utilizing a compression spring biased diaphragm is shown in FIG. 11, clearly the system is not limited to this and a number of such units could be employed.

It is also envisioned that when serving beverages which do not require carbonation, an alternative gas propellant, such as compressed air, nitrogen, etc., could be employed.

Further, the shapes of the water storage tanks, the isolation storage tank units and the product storage container are not limited to diametrical or cylindrical shapes.

The self-contained beverage dispensing system according to the present invention includes the following advantages:

(1) Beverages that require purity to the extent that they are not permeated with the propellant gas can now be stored for extended periods of time and served without any contamination.

(2) Water can be stored over extended periods of time in a single vessel to supply both a source of flat water and also a source of water to be subsequently carbonated, thereby making it possible to dispense both flat water and carbonated water.

Both of the above-noted advantages are accomplished by an isolating, pliable, diaphragm which completely separates the propellant gas from the water or the beverage which is stored and also dispensed.

It is contemplated that numerous modifications may be made to the self-contained beverage dispensing system of the present invention without departing from the spirit and scope of the invention as defined in the following claims.

What is claimed is:

1. A self-contained beverage dispensing system comprising:

a) housing means;

b) a refillable source of $CO_2$ gas under pressure and disposed in said housing means;

c) a refillable water storage means, disposed in said housing means, for storing flat water and including a water isolation means for dividing said water storage means into a water storage portion and a separate portion, said separate portion including means for biasing said water isolation means and operative to force said flat water out of said water storage portion, said water storage means including a water refill inlet and a flat water outlet both being communicated with the water storage portion;

d) a flat water line connected to said water storage portion of said water storage means via said flat water outlet;

e) isolation storage means, disposed in said housing means, for storing a non-carbonated beverage and including a beverage isolation means for separating said isolation storage means into a beverage storage portion and a separate portion, said separate portion of said isolation storage means including means for biasing said beverage isolation means and operative to force said non-carbonated beverage out of said beverage storage portion;

f) a carbonator, in communication with said $CO_2$ gas source and also with said flat water line, for carbonating at least a portion of said flat water supplied from said water storage means;

g) dispensing valve means for dispensing a selected one of said flat water, said carbonated water and said non-carbonated beverage; and h) means for communicating said dispensing valve means with each of said water storage means, said carbonator and said isolation storage means.

2. The self-contained beverage dispensing system according to claim 1, wherein said water isolation means comprises a diaphragm.

3. The self-contained beverage dispensing system according to claim 1, wherein said beverage isolation means comprises a diaphragm.

4. The self-contained beverage dispensing system according to claim 2, wherein said biasing means for biasing said water isolation means comprises pressurized $CO_2$ gas supplied from said $CO_2$ gas source.

5. The self-contained beverage dispensing system according to claim 3, wherein said biasing means for biasing said beverage isolation means comprises pressurized $CO_2$ gas supplied from said $CO_2$ gas source.

6. The self-contained beverage dispensing system according to claim 2, wherein said biasing means for biasing said water isolation means comprises a compression spring interposed between said diaphragm and said water storage means.

7. The self-contained beverage dispensing system according to claim 3, wherein said biasing means for biasing said beverage isolation means comprises a compression spring interposed between said diaphragm and said isolation storage means.

8. The self-contained beverage dispensing system according to claim 1, further comprising a refillable beverage storage means disposed in said housing means and a $CO_2$ gas pipeline for communicating said $CO_2$ gas source with an upper portion of said refillable beverage storage means, said refillable beverage storage means including a take-up tube which communicates with said dispensing valve means through a further communicating means, so that $CO_2$ gas under pressure directly contacts a further beverage stored in said refillable beverage storage means and is operative to force said further beverage out through said take-up tube and to said dispensing valve means where said further beverage is dispensed as a carbonated beverage.

9. The self-contained beverage dispensing system according to claim 1, wherein said housing means is a portable cabinet mounted on wheels and is adapted for use on commercial aircraft.

10. The self-contained beverage dispensing system according to claim 1, wherein said water storage means and said isolation storage means are each divided into an upper liquid storage portion and a lower biasing means accommodating portion.

11. A self-contained beverage dispensing system comprising:

a) housing means;

b) a refillable source of $CO_2$ gas under pressure and disposed in said housing means;

c) water storage means, disposed in said housing means, for storing flat water and including a water isolation means for dividing said water storage means into a water storage portion and a separate portion, said separate portion including means for biasing said water isolation means and operative to force said flat water out of said water storage portion;

d) a flat water line connected to said water storage portion of said water storage means;

e) isolation storage means, disposed in said housing means, for storing a non-carbonated beverage and including a beverage isolation means for separating said isolation storage means into a beverage storage portion and a separate portion, said separate portion of said isolation storage means including means for biasing said beverage isolation means and operative to force said non-carbonated beverage out of said beverage storage portion;

f) a carbonator, in communication with said $CO_2$ gas source and also with said flat water line, for carbonating at least a portion of said flat water supplied from said water storage means;

g) dispensing valve means for dispensing a selected one of said flat water, said carbonated water and said non-carbonated beverage; and h) means for communicating said dispensing valve means with each of said water storage means said carbonator and said isolation storage means, wherein said water isolation means comprises a diaphragm, and wherein said biasing means for biasing said water isolation means comprises a compression spring interposed between said diaphragm and said water storage means.

12. A self-contained beverage dispensing system comprising:

a) housing means;

b) a refillable source of $CO_2$ gas under pressure and disposed in said housing means;

c) water storage means, disposed in said housing means, for storing flat water and including a water isolation means for dividing said water storage means into a water storage portion and a separate portion, said separate portion including means for biasing said water isolation means and operative to force said flat water out of said water storage portion;

d) a flat water line connected to said water storage portion of said water storage means;

e) isolation storage means, disposed in said housing means, for storing a non-carbonated beverage and including a beverage isolation means for separating said isolation storage means into a beverage storage portion and a separate portion, said separate portion of said isolation storage means including means for biasing said beverage isolation means and operative to force said non-carbonated beverage out of said beverage storage portion;

f) a carbonator, in communication with said $CO_2$ gas source and also with said flat water line, for carbonating at least a portion of said flat water supplied from said water storage means;

g) dispensing valve means for dispensing a selected one of said flat water, said carbonated water and said non-carbonated beverage; and h) means for communicating said dispensing valve means with each of said water storage means, said carbonator and said isolation storage means, wherein said beverage isolation means comprises a diaphragm, and wherein said biasing means for biasing said beverage isolation means comprises a compression spring interposed between said diaphragm and said isolation storage means.

* * * * *